United States Patent [19]

Yamauchi et al.

[11] 4,148,043

[45] Apr. 3, 1979

[54] TWO-COLOR ELECTROSTATIC PRINTING APPARATUS

[75] Inventors: Mineo Yamauchi; Akira Sumi, both of Musashino, Japan

[73] Assignee: Yokogawa Electric Works, Ltd., Tokyo, Japan

[21] Appl. No.: 782,095

[22] Filed: Mar. 28, 1977

[30] Foreign Application Priority Data

Mar. 31, 1976 [JP] Japan ..... 51-35640

[51] Int. Cl.[2] ..... G03G 15/02

[52] U.S. Cl. ..... 346/157; 346/154

[58] Field of Search ..... 346/157, 153, 154; 355/14

[56] References Cited

U.S. PATENT DOCUMENTS

| | | | |
|---|---|---|---|
| 3,045,644 | 7/1962 | Schwertz | 346/157 |
| 3,069,681 | 12/1962 | Sloan | 346/157 |
| 3,094,429 | 6/1963 | Howell | 346/157 |
| 3,430,254 | 2/1969 | Schwertz | 346/157 |
| 3,480,963 | 11/1969 | Stowell | 346/157 |

*Primary Examiner*—Jay P. Lucas

*Attorney, Agent, or Firm*—Parmelee, Johnson, Bollinger & Bramblett

[57] ABSTRACT

A two-color electrostatic printing apparatus capable of producing two-color images printed on a sheet of paper with two colored toners. The apparatus comprises a paper feed mechanism for driving the paper at a predetermined speed, a charging part for selectively forming positive and negative electrostatic latent images on the paper, a developing part for attracting positive-charged and negative-charged two colored toners simultaneouslv onto the latent images so as to render the latent images visible, and a fixing part for thermally fusing the toners attracted onto the electrostatic latent images.

14 Claims, 22 Drawing Figures

TWO-COLOR ELECTROSTATIC PRINTING APPARATUS

BACKGROUND OF THE INVENTION

1. Field of the Invention

The present invention relates to a two-color electrostatic printing apparatus of the type that forms positive and negative electrostatic latent images on a sheet of print paper, then develops the latent images with two colored toners charged in positive and negative polarities, and fuses the toners thermally on the print paper.

2. Description of the Prior Art

Heretofore a variety of non-impact electrostatic printing apparatus have been developed and implemented for practical use. However, printed images obtained in the conventional apparatus are monochromatic, and it is extremely difficult to indicate an alarm, emphasis or caution signal by such printed images. In addition, due to inclusion of a transfer process in the known electrostatic printing apparatus, the structures have been complicated.

SUMMARY OF THE INVENTION

It is an object of the present invention to provide an improved electrostatic printing apparatus capable of performing two-color printing without any transfer process. And another object of the invention resides in providing an improved apparatus for effecting clear two-color printing.

The present invention is equipped with a paper feed mechanism to drive print paper, a charging part for selectively forming positive and negative electrostatic latent images on the print paper, a developing part for rendering the latent images visibly by attracting two colored toners thereto simultaneously, and a fixing part for thermally fusing the toners attracted onto the latent images. In the two-color electrostatic printing apparatus thus implemented, it is possible to achieve remarkable clearness with respect to two-color printing through various improvements accomplished in the charging and developing parts.

DESCRIPTION OF THE PREFERRED EMBODIMENT

Figure 1:
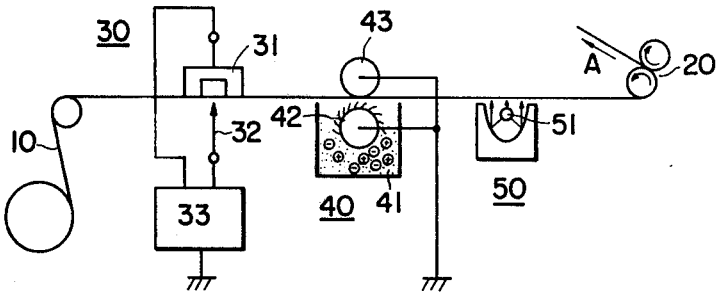
FIG. 1 schematically illustrates the structure of an apparatus embodying the present invention.
Figure 2:
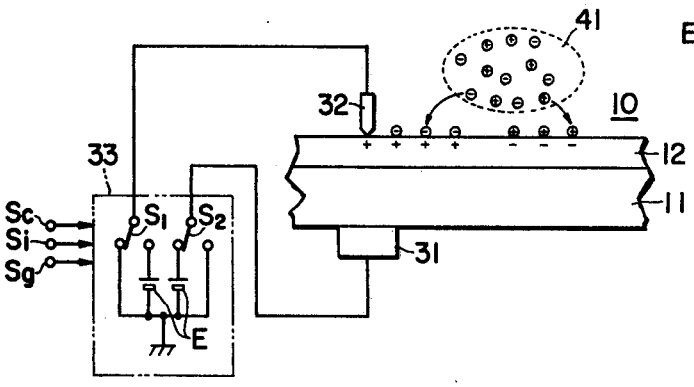
FIG. 2 illustrates the principle of its operation.

FIG. 1 schematically illustrates the structure of an apparatus embodying the present invention, and FIG. 2 illustrates the principle of its operation. In the drawings: 10 is a sheet of print paper; 20 is a paper feed mechanism; 30 is a charging part; 40 is a developing part; and 50 is a fixing part. The print paper 10 is composed of a base 11 and a coating of dielectric layer 12 chargeable in both positive and negative polarities. The paper feed mechanism 20 moves the print paper 10 at a predetermined speed in the direction of, for example, an arrow A. The charging part 30 consists of an opposite electrode 31 so disposed as to be in contact with the base 11 of print paper 10, a discharge electrode 32 positioned opposite to the dielectric layer 12 of print paper 10, and a drive circuit 33 for applying predetermined voltages to the opposite electrode 31 and the discharge electrode 32. The developing part 40 consists of a developer 41 containing a first toner charged, for example, in a positive polarity and a second toner charged in a negative polarity, a rotary magnetic mechanism 42 for attracting the developer 41 magnetically onto its outer surface to form a magnetic brush of the developer, and a paper holding roll 43. Both the rotary magnetic mechanism 42 and the paper holding roll 43 are grounded. And the fixing part 50 consists of a heating means such as infrared heater 51 disposed opposite to the print paper 10.

The apparatus of the above-described structure operates in the following manner. First in the charging part 30, switches S1 and S2 constituting the drive circuit 33 are selectively turned on or off in response to a color designation signal Sc, a print information signal Si and a print control signal Sg, and predetermined voltages are applied to the opposite electrode 31 and the discharge electrode 32. In the case where color designation signal Sc corresponds to a positive electrostatic latent image, the voltage applied to the opposite electrode 31 is zero while the voltage applied to the discharge electrode 32 is +E. To the contrary, in the case where color designation signal Sc corresponds to a negative electrostatic latent image, the voltage applied to the opposite electrode 31 is +E while the voltage applied to the discharge electrode 32 is zero. Supposing now that the threshold voltage Eth for forming a latent image on the dielectric layer 11 of print paper 10 and the output voltage of drive circuit 33 satisfy the relationship $|E/2| < |Eth| < |E|$, then in the former case the potential difference between the two electrodes becomes +E to form a positive latent image on the dielectric layer 12, whereas in the latter case the potential difference between the two electrodes becomes −E to form a negative latent image on the dielectric layer 12. It is possible to obtain positive and negative latent images on alternating rows by moving the print paper 10 at a speed such that the pitch of successive rows of dots is half (125μm) of the pitch (250 μm) of dots of a single color, that speed being determined by a cycle of inversion of the polarity of color designation signal Sc (See FIG. 7). Since the running pitch of print paper 10 is extremely small, the positive and negative latent images appear as if they were formed on the same row.

In the developing part 40, the toners charged in predetermined polarities are attracted onto the latent images to render the images visible in the following manner. A magnetic brush formed from the developer 41 on the outer surface of rotary magnetic mechanism 42 is brought into contact with the dielectric layer 12 of print paper 10 where the electrostatic latent images are formed. Then the negative-charged toner is attracted to the positive latent image by the coulomb force while the positive-charged toner is attracted similarly to the negative latent image to produce visible images. Accordingly, if a red pigment is contained in the positive-charged toner and a black pigment in the negative-charged toner, red and black visible images are obtained.

In the fixing part 50, the visible images thus formed are fused thermally onto the print paper 10. Although this embodiment employs an infrared heater 51 for heating the toners on the print paper 10 to effect fusion thereto, a plate heater is also usable. In this way, the visible images composed of the two colored toners are fixed on the print paper 10.

Figure 3:
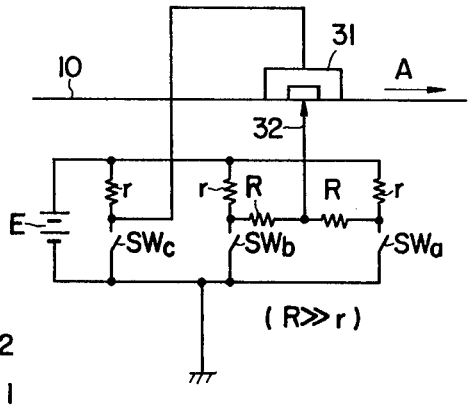
FIG. 3 is a schematic circuit diagram showing an example of the charging part in FIG. 1.

FIG. 3 is a schematic circuit diagram showing an example of the charging part 30 in FIG. 1, wherein a single discharge electrode is shown for illustration. In this diagram: R and r are a voltage dividing resistor and a protective resistor of which values are so set as to satisfy the relation $R > r$; SWa—SWc are switches; and E is a d-c power source having a voltage E. The two resistors R are connected in series to constitute a voltage-dividing resistance circuit. The discharge electrode 32 is connected to the midpoint of the voltage-dividing resistance circuit, of which one end is connected to the anode of d-c power source E through protective resistor r while being grounded through switch SWa. The other end of the voltage-dividing resistance circuit is connected also to the anode of d-c power source E through protective resistor r while being grounded through switch SWb. And the opposite electrode 31 is connected also to the anode of d-c power source E through protective resistor r while being grounded through switch SWc. In this circuit configuration: switch SWa is turned on or off in response to color designation signal Sc and print information signal Si; switch SWb is turned on or off in response to color designation signal Sc and print control signal Sg; and switch SWc is turned on or off in response to color designation signal Sc respectively. And the voltages applied to opposite electrode 31 and discharge electrode 32 are changed in accordance with the combination of the on-off states of switches SWa, SWb and SWc. The voltage applied to the opposite electrode 31 is zero in the on-state of SWc or E in the off-state of SWc. And the voltage applied to the discharge electrode 32 is zero in the on-states of both SWa and SWb, or E/2 in the on-state of either SWa or SWb, or E in the off-states of both SWa and SWb. Consequently, when switch SWc is turned on and switches SWa, SWb are turned off, the potential difference applied across the print paper 10 becomes +E to form a positive latent image. To the contrary, when switch SWc is turned off and switches SWa, SWb are turned on, the potential difference applied across the print paper 10 becomes −E to form a negative latent image. And in any other combination of the on-off states, the potential difference applied across the print paper 10 becomes zero or ±E/2 so that no latent image is formed.

Figure 4:
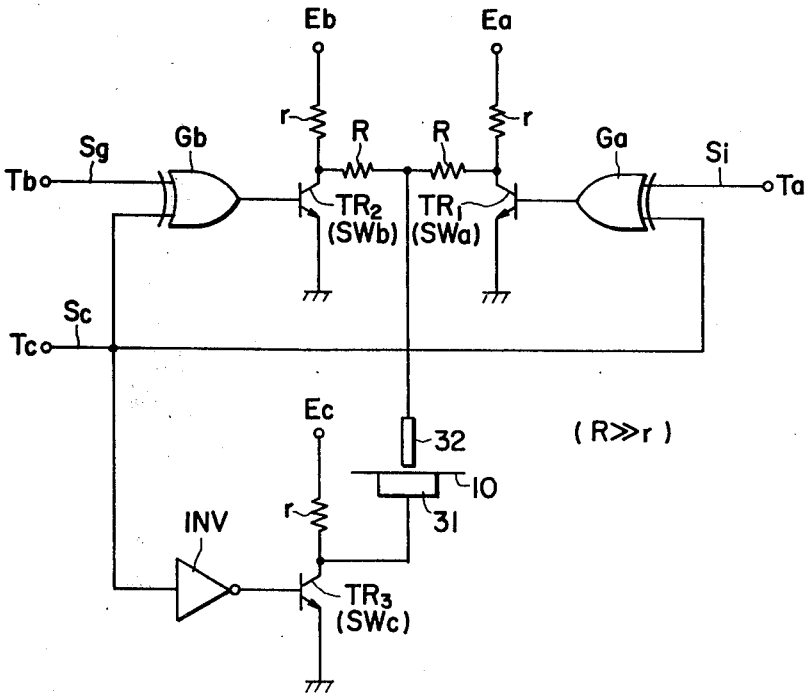
FIG. 4 is a detailed circuit diagram of the example of FIG. 3.

FIG. 4 is a detailed circuit diagram of the example shown in FIG. 3, wherein the component elements corresponding to those in FIG. 3 are labeled the same symbols. In FIG. 4; TR1–TR3 are transistors serving as switches SWa–SWc respectively; Ga and Gb are exclusive or gates; INV is an inverter; Ea–Ec are voltage terminals to which a voltage E is applied; Ta is an input terminal for print information signal Sg; Tb is an input terminal for print control signal Sg; and Tc is an input terminal for color designation signal Sc. The collector of transistor TR1 is connected to one end of the potential-dividing resistance circuit and also to the voltage terminal Ea through protective resistor r. The base of transistor TR1 is connected to the output terminal of exclusive or gate Ga, and its emitter is grounded. The collector of transistor TR2 is connected to the other end of the voltage-dividing resistance circuit and also to the voltage terminal Eb through protective resistor r. The base of transistor TR2 is connected to the output terminal of exclusive or gate Gb, and its emitter is grounded. The collector of transistor TR3 is connected to the opposite electrode 31 and also to the voltage terminal Ec through protective resistor r. The base of transistor TR3 is connected to the input terminal Tc through inverter INV, and its emitter is grounded. One input terminal of exclusive or gate Ga is connected to the input terminal Ta, while the other input terminal of Ga is connected to the input terminal Tc. And one input terminal of exclusive or gate Gb is connected to the input terminal Tb, while the other input terminal of Gb is connected to the input terminal Tc.

Figure 5:
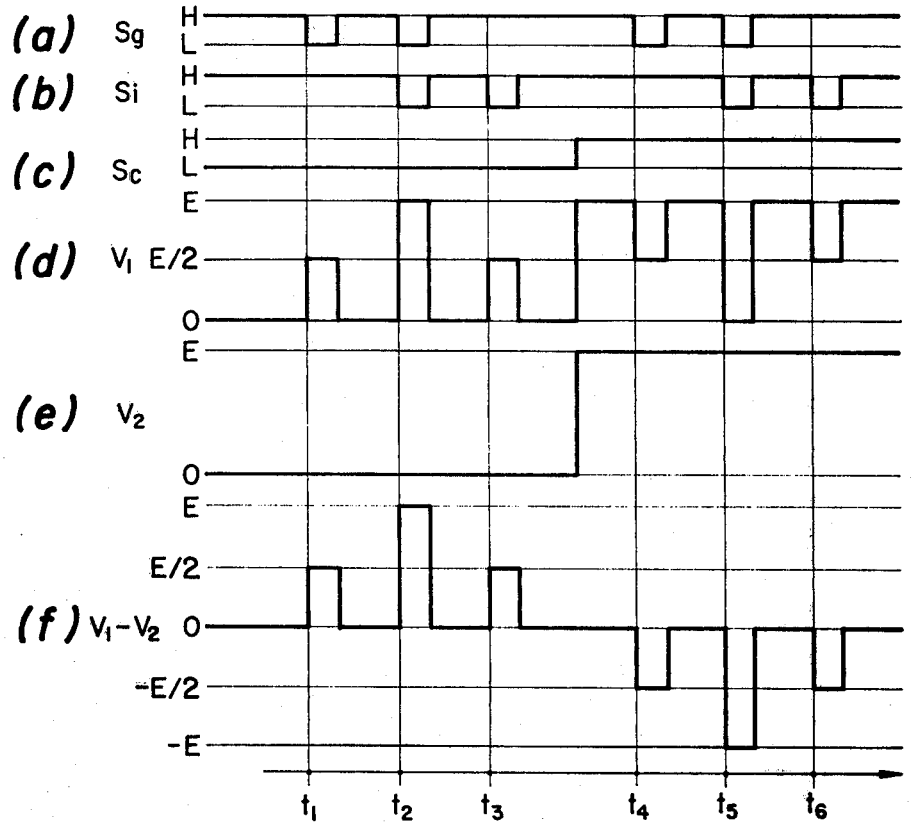
FIG. 5, including a-f, is a waveform chart plotted for explanation of the operation in FIG. 4.

FIG. 5 is a waveform chart plotted for explanation of the operation in FIG. 4, in which: (a) is the waveform of print control signal Sb applied to input terminal Tb; (b) is the waveform of print information signal Si applied to input terminal Ta; (c) is the waveform of color designation signal Sc applied to input terminal Tc; (d) is the waveform of voltage V1 applied to discharge electrode 32; (e) is the waveform of voltage V2 applied to opposite electrode 31; and (f) is the waveform of potential difference V1–V2 applied across print paper 10. At time t1 in FIG. 5, Sg and Sc are "L" while Si is "H" to cause turn-on of switches SWa and SWc and turn-off of switch SWb, so that the potential difference applied across the print paper 10 becomes +E/2. At time t2, all of Sg, Si and Sc are "L" to cause turn-off of switches SWa and SWb and turn-on of switch SWc, so that the potential difference across the print paper 10 becomes +E to form a positive electrostatic latent image thereon. At time t3, Sg is "H" while Si and Sc are "L" to cause turn-on of switch SWa and turn-off of switches SWb and SWc, so that the potential difference across the print paper 10 becomes +E/2. At time t4, Sg is "L" while Si and Sc are "H" to cause turn-off of switches SWa and SWc and turn-on of switch SWb, so that the potential difference across the print paper 10 becomes −E/2. At time t5, Sg and Si are "L" while Sc is "H" to cause turn-on of switches SWa and SWb and turn-off of switch SWc, so that the potential difference across the print paper 10 becomes −E to form a negative electrostatic latent image thereon. Further at time t6, Sg and Sc are "H" while Si is "L" to cause turn-on of switch SWa and turn-off of switches SWb and SWc, so that the potential difference across the print paper 10 becomes −E/2.

As is obvious from the above, the on-off states of switches SWa, SWb and SWc in the circuit of FIG. 4 are controlled by print information signal Si, print control signal Sg and color designation signal Sc, and these switches function as a circuit to drive the discharge electrode 31 and the opposite electrode 32.

Figure 6:
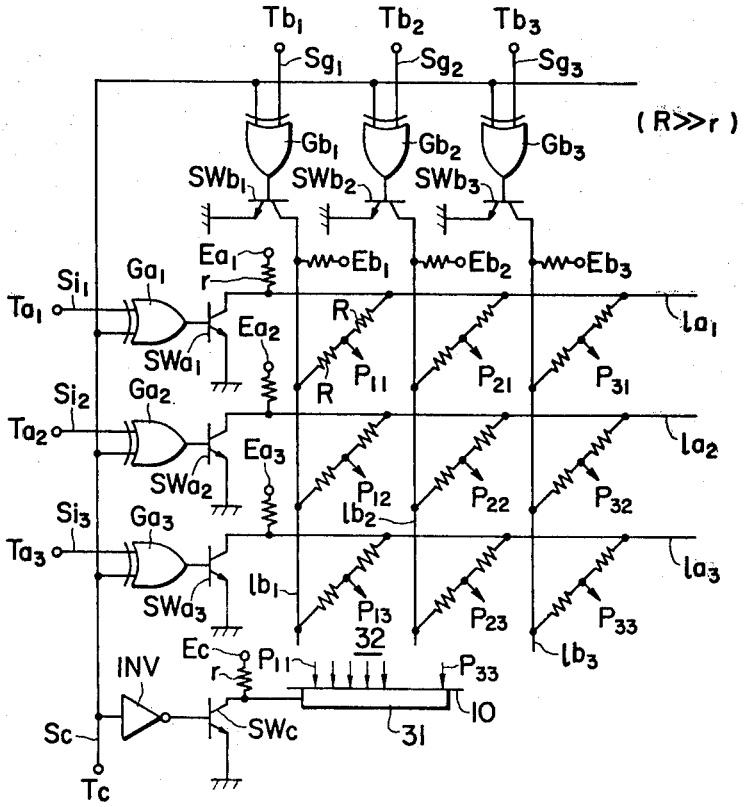
FIG. 6 is a circuit diagram illustrating how to selectively drive, by the use of the circuit shown in FIG. 4, a discharge electrode consisting of multiple cat-whisker-like electrode pins.

FIG. 6 is a circuit diagram illustrating how to selectively drive, by the use of the circuit shown in FIG. 4, a discharge electrode consisting of an array of multiple cat-whisker-like electrodes, wherein the component elements corresponding to those in FIG. 5 are labeled with the same symbols. In FIG. 6; P11–P33 are cat-whisker-like electrodes serving as a discharge electrode 32 and arranged in a row in the direction orthogonal with the paper feed direction, and the opposite electrode 31 is shaped into a single continuous structure in the manner to be opposite to the cat-whiskers constituting the discharge electrode 32; la1–la3 are first drive lines connected respectively to the output terminals of switches SWa1–SWa3 constituting a first drive circuit group SWa; and lb1–lb3 are second drive lines connected respectively to the output terminals of switches SWb1–SWb3 constituting a second drive circuit group SWb. The first drive lines la and the second drive lines lb are connected with each other at their intersections through voltage-dividing resistance circuits each consisting of a series circuit of resistors R, and each of the cat-whiskers P11–P33 is connected to the midpoint of the related voltage-dividing resistance circuit. If these resistance circuits and cat-whiskers P11–P33 are arranged on individual base plates, wiring between them becomes complicated. For the purpose of avoiding such complication, in this embodiment, the voltage-dividing resistance circuits and the cat-whiskers P11–P33 are disposed on the same plate to achieve simplification of the wiring and also reduction of the component elements. In this circuit constitution, the cat-whiskers P11–P33 are driven selectively by the first drive circuit group SWa and the second drive circuit group SWb so that a predetermined voltage zero, E/2 or E is applied thereto. And in the same manner as in FIG. 4, electrostatic latent images charged in predetermined polarities are formed selectively on the print paper 10 in accordance with print information signal Si, print control signal Sg and color designation signal Si.

Figure 7:
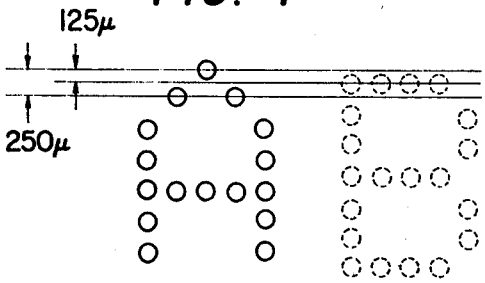
FIG. 7 depicts patterns of exemplary images formed by the apparatus of FIG. 1.

FIG. 7 depicts patterns of exemplary images obtained by a two-color electrostatic printing apparatus having the above-described charging part, wherein the pattern "A" is formed of negative electrostatic latent images, and the pattern "B" is formed of positive electrostatic latent images.

Thus, according to the circuit of FIG. 3, it is possible to produce positive and negative latent images selectively on the print paper 10 in a relatively simple circuit formation by controlling the voltages applied to the opposite electrode 31 and the discharge electrode 32.

In this apparatus, however, since positive and negative latent images are formed alternately on every other row as illustrated in FIG. 7, if each dot of the discharge electrode is large in diameter, the latent images created on the print paper in relation to the paper feed speed may partially overlap the discharge electrode that forms latent images of the opposite polarity in the next stage. Regarding the positive latent image formed on the print paper, the surface potential is approximately E/2 as it is substantially equal to the difference between the charge voltage and the initial discharge voltage. Meanwhile, when a voltage −E/2 in the semi-selected state is applied to the discharge electrode 32 where the positive latent image overlaps partially, then a potential −E is produced between the positive latent image and the discharge electrode 32 to initiate a discharge, thereby removing the electric charge from the overlapping portion of the positive latent image to bring about an incomplete printed image with dropout of the dot. Such a phenomenon is avoidable by preventing application of −E/2 to the discharge electrode 32.

Figure 8:
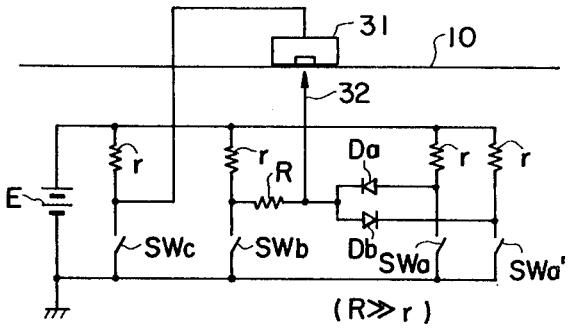
FIG. 8 is a schematic circuit diagram showing another example of the charging part in FIG. 1.

FIG. 8 is a schematic diagram of an exemplary circuit adapted to meet this requirement, wherein a single discharge electrode is plotted for illustration as in FIG. 3, and the component elements corresponding to those in FIG. 3 are labeled the same reference symbols. In FIG. 8, SWa′ is a switch similar to SWa–SWc, and Da, Db are diodes. The cathode of diode Da is connected to the node between resistor R and discharge electrode 32, and the anode of Da is connected to the anode of d-c power source E through protective resistor r while being grounded through switch SWa. The andoe of diode Db is connected to the node between resistor R and discharge electrode 32, and the cathode of Db is connected to the anode of d-c power source E through protective resistor r while being grounded through switch SWa′. In this circuit constitution, only when switches SWa and SWc are on while switches SWb and SWa′ are off, the potential difference applied across the print paper 10 becomes +E to form a positive electrostatic latent image. And only when switches SWa and SWb are on while switches SWc and SWa′ are off, the potential difference applied across the print paper 10 becomes −E to form a negative electrostatic latent image. In any other combination of the on-off states of the switches, the potential difference across the print paper 10 becomes zero.

Figure 9:
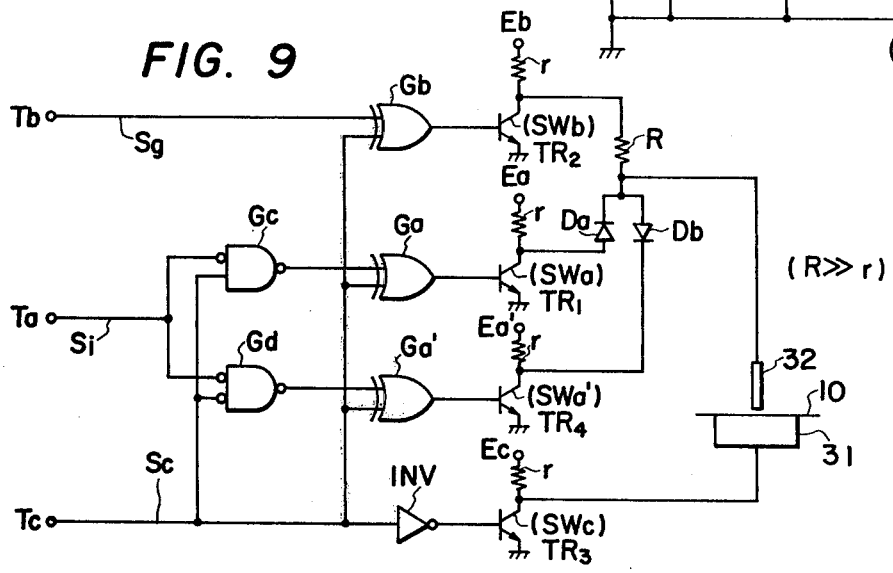
FIG. 9 is a detailed circuit diagram of the example of FIG. 8.

FIG. 9 is a detailed circuit diagram of the example shown in FIG. 8, wherein the component elements corresponding to those in FIG. 8 are labeled the same reference symbols. In FIG. 9: TR4 is a transistor serving as switch SWa′; Ga′ is an exclusive or gate; Gc and Gd are logic gates; and Ea′ is a voltage terminal to which voltage E is applied. The collector of transistor TR1 is connected to the anode of diode Da. The collector of transistor TR4 is connected to the cathode of diode Db and also to voltage terminal Ea′ through protective resistor r. The base of TR4 is connected to the output terminal of exclusive or gate Ga′, and the emitter is grounded. One input terminal of exclusive or gate Ga is connected to the output terminal of logic gate Gc, while the other input terminal is connected to the input terminal Tc. One input terminal of exclusive or gate Ga' is connected to the output terminal of logic gate Gd, while the other input terminal is connected to the input terminal Tc. One input terminal of logic gate Gc is connected to the input terminal Ta, while the other input terminal is connected to the input terminal Tc. And one input terminal of logic gate Gd is connected to the input terminal Ta, while the other input terminal is connected to the input terminal Tc.

Figure 10:
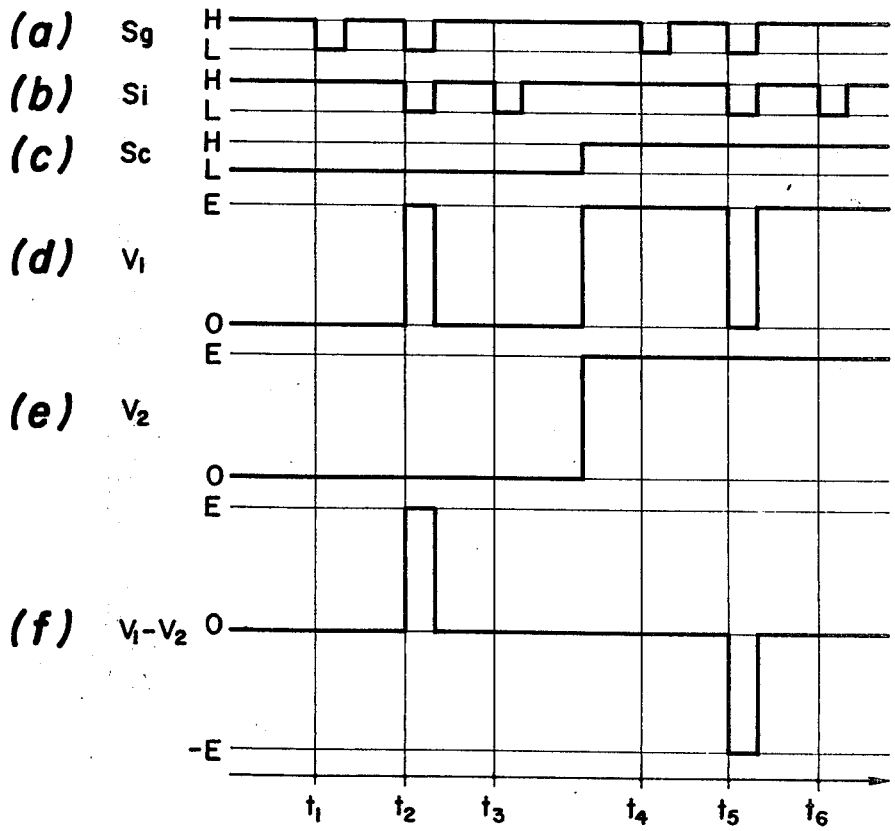
FIG. 10, including a-f, is a waveform chart plotted for explanation of the operation in FIG. 9.

FIG. 10 is a waveform chart plotted for explanation of the operation in FIG. 9, in which: (a) is the waveform of print control signal Sg applied to input terminal Tb; (b) is the waveform of print information signal Si applied to input terminal Ta; (c) is the waveform of color designation signal Sc applied to input terminal Tc; (d) is the waveform of voltage V1 applied to discharge electrode 32; (e) is the waveform of voltage V2 applied to opposite electrode 31; and (f) is the waveform of potential difference V1–V2 applied across print paper 10. At time t1 in FIG. 10, Sg and Sc are "L" while Si is "H" to cause turn-on of switches SWA, SWa' and SWc and turn-off of switch SWb, so that the potential difference applied across the print paper 10 becomes zero. At time t2, all of Sg, Si and Sc are "L" to cause turn-on of switches SWa and SWc and turn-off of switches SWa' and SWb, so that the potential difference across the print paper 10 becomes +E to form a positive electrostatic latent image thereon. At time t3, Sg is "H" while Si and Sc are "L" to cause turn-on of switches Swa, SWb and SWc and turn-off of SWa', so that the potential difference across the print paper 10 becomes zero. At time t4, Sg is "L" while Si and Sc are "H" to cause turn-off of switches SWa, SWa' and SWc and turn-on of switch SWb, so that the potential difference across the print paper 10 becomes zero. At time t5, Sg and Si are "L" while Sc is "H" to cause turn-on of switches SWa and SWb and turn-off of switches SWa' and SWc, so that the potential difference across the print paper 10 becomes −E to form a negative electrostatic latent image thereon. Further at time t6, Sg and Sc are "H" while Si is "L" to cause turn-on of switch SWa and turn-off of switches SWa', SWb and SWc, so that the potential difference across the print paper 10 becomes zero.

As is obvious from the above, the voltage applied to the discharge electrode 32 becomes either zero or E in the circuit of FIG. 9, that is, in the circuit of FIG. 8, and the voltage E/2 in the semi-selected state is not applied differently from the examples of FIGS. 3 through 5. Consequently, no electric charge is removed from the latent image formed on the print paper 10. And there never occurs such combination of switches that SWa is on and SWa' is off. Therefore, in the constitution and operation mentioned above, it is also possible to prevent flow of a rush current in a path of switch SWa—diode Da—diode Db—switch SWa'.

Figure 11:
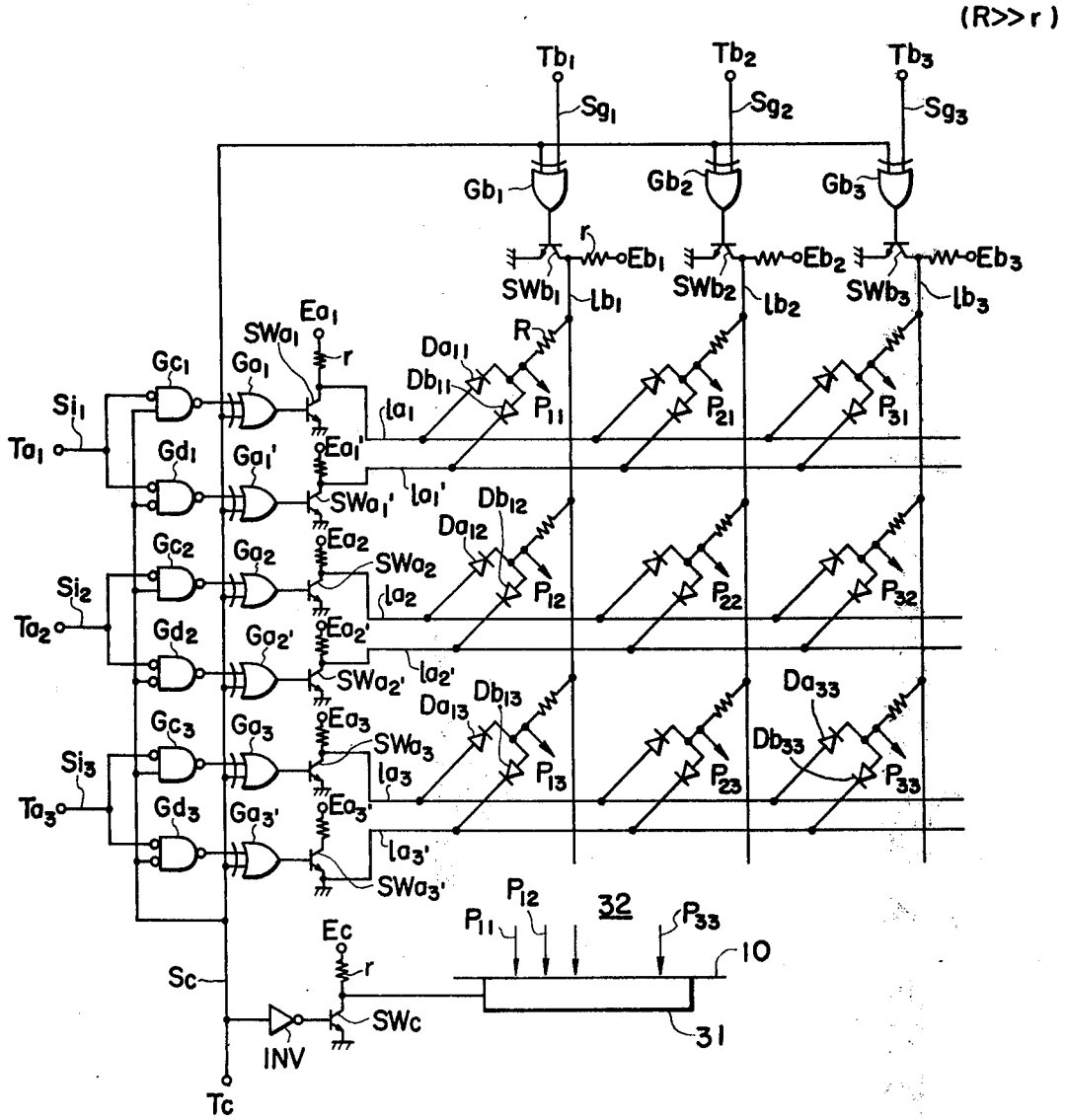
FIG. 11 is a circuit diagram illustrating how to selectively drive, by the use of the circuit shown in FIG. 9, a discharge electrode consisting of multiple cat-whisker-like electrode pins.

FIG. 11 is a circuit diagram illustrating how to selectively drive, by the use of the circuit shown in FIG. 9, a discharge electrode consisting of multiple cat-whiskers, wherein the component elements corresponding to those in FIGS. 6 and 9 are labeled the same reference symbols. In FIG. 11, la1'–la3' are third drive lines connected respectively to the output terminals of switches SWa1'–SWa3' constituting a third drive circuit group SWa'. The first drive lines la and the second drive lines 1b are connected with each other at the intersections through series circuits each consisting of a diode Da and a resistor R, and the third drive lines la' and the second drive lines 1b are connected with each other at the intersections through series circuits each consisting of a resistor R and a diode Db connected in the direction opposite at the diode Da. And each of the cat-whiskers P11–P33 is connected to the mid joint of the related diodes Da, Db and resistor R. In this circuit consitution, cat-whiskers P11–P33 are driven selectively by first drive circuit group SWa, second drive circuit group SWb and third drive circuit group SWa' so that a predetermined voltage zero or E is applied thereto. And in the same manner as in FIG. 9, electrostatic latent images charged in predetermined polarities are formed selectively on the print paper 10 in accordance with print information signal Si, print control signal Sg and color designation signal Si. And removal of the electric charge as observed in the circuit of FIG. 3 never occurs in any of these latent images, thereby ensuring high quality in the printed images.

Figure 12:
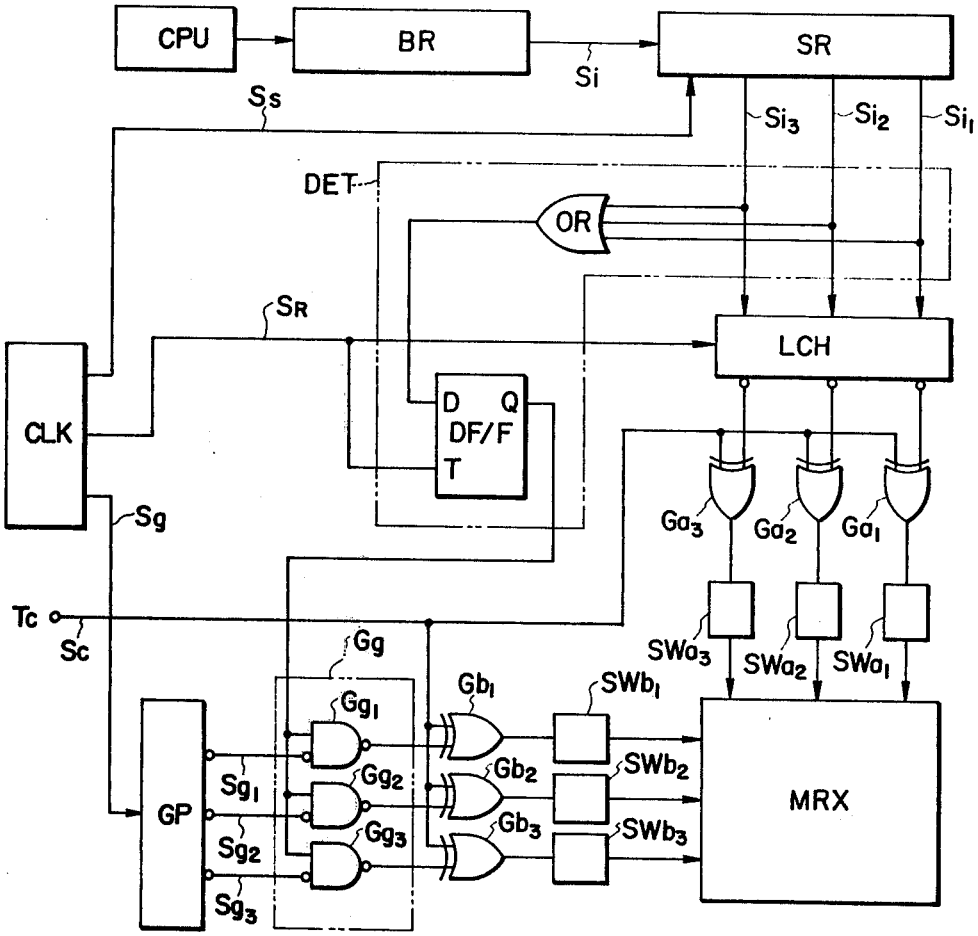
FIG. 12 is a circuit diagram showing another example of the charging part in FIG. 1.

FIG. 12 shows another example of a circuit adapted to prevent the charge-removal phenomenon occurring in the aforementioned circuit of FIG. 3, wherein the component elements corresponding to those in FIG. 6 are labeled the same reference symbols. In FIG. 12, MRX is a set of cat-whiskers connected to make up an array of matrix through voltage-dividing resistance circuits in the same manner as the cat-whiskers P11–P33 in FIG. 3; CLK is a clock pulse generator; GP is a print control signal generator; CPU is a computer; BR is a buffer register; SR is a shift register; LCH is a latch circuit; DET is a detector consisting of an or gate OR and an edge-trigger D-type flip-flop circuit DF/F; and Gg1–Gg3 are AND gates. The clock pulse generator CLK is capable of generating various output signals while maintaining a fixed timing relation, and feeds shift pulse Ss to shift register SR, strobe pulse SR to latch circuit LCH, and gate pulse Sg to print control signal generator GP respectively. In response to gate pulse Sg, print control signal generator GP repeats sequential generation of print control signals Sg1–Sg3 each having a fixed pulse width, and these control signals are fed to exclusive OR gates Gb1–Gb3 through the related AND gates Gg1–Gg3 respectively. Computer CPU generates print information signal Si for selectively driving the individual cat-whiskers of MRX, and the output signal Si of computer CPU is loaded in shift register SR through buffer register BR. The shift register SR loads a predetermined number of print information signals Si1–Si3 in accordance with shift pulse Ss and then feeds these information signals to latch circuit LCH. In accordance with strobe pulse SR, the latch circuit LCH reads out the print information signals Si1–Si3 loaded in the shift register SR and stores the signals temporarily, and feeds them to the related exclusive OR gates Ga1–Ga3 respectively. Each bit output of the shift register SR is connected to the or gate OR so as to detect the presence or absence of print information signals Si1–Si3 in the shift register SR. The terminal D of flip-flop circuit DF/F is connected to the output terminal of or gate OR, and strobe pluse SR is fed to the terminal T of flip-flop circuit DF/F. Thus, when there exists even a single print information signal Si in the shift register SR, the output Q of flip-flop circuit DF/F becomes "H", and when there is no signal Si at all, the output Q becomes "L". Meanwhile, the output terminal Q of flip-flop circuit DF/F is connected to the other input terminal of AND gates Gg1–Gg3. It follows that the gating action of AND gates Gg1–Gg3 is controlled by the output of flip-flop circuit DF/F, and only when the output Q becomes "H", print information signals Sg1–Sg3 are sent out to exclusive OR gates Gb1–Gb3. Accordingly, feeding of print control signal Sg to exclusive OR gate Gb is inhibited during the period of complete absence of print information signal Si, thereby allowing the switch SWb to remain unactuated. This prevents switches SWb1–SWb3 from applying voltage E/2 to cat-whiskers P11–P33 and reduces generation of the aforementioned charge-removal phenomenon. Furthermore, the above circuit formation inhibits the action of switch SWb not contributing to the printing operation, hence eliminating power loss concomitant with switching. For the detector DET, various configurations are possible through combination of logic circuits.

In the circuit of FIG. 3, when forming a negative electrostatic latent image on the print paper 10, a current resulting from the voltage E applied to the opposite electrode 31 flow to the developing part 40 by way of the print paper 10 and generates an electric field in the developing space between the rotary magnetic mechanism 42 and the print paper 10 in the developing part 40. This electric field acts equivalently as a positive developing bias voltage to attract the negative-charged toner, hence causing greasing that appears in the form of striped fogging proportional to the voltage applied to the opposite electrode 31.

Figure 13:
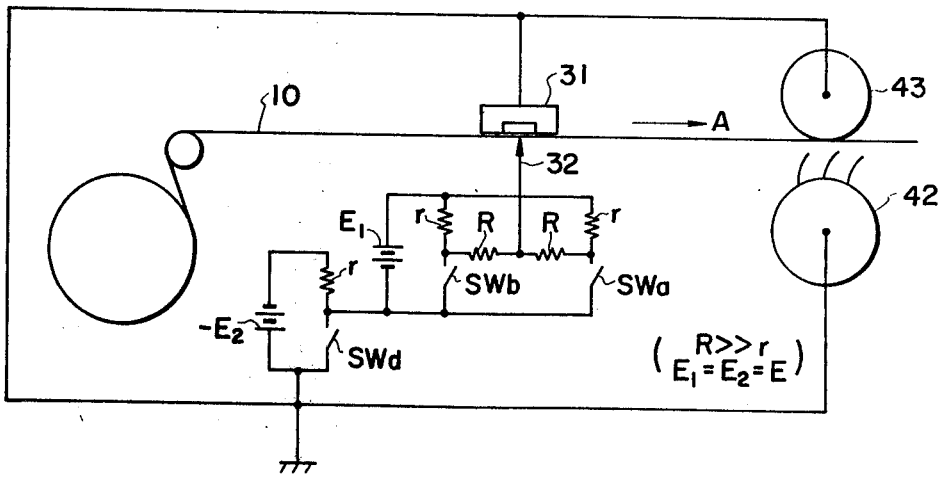
FIG. 13 is a schematic circuit diagram showing, with a developing part, another example of the charging part in FIG. 1.

FIG. 13 is a circuit diagram showing an exemplary circuit adapted for prevention of such greasing that occurs in FIG. 3, wherein the component elements corresponding to those in FIG. 3 are labeled the same reference symbols. In FIG. 13, E1 and E2 are d-c power sources each having a voltage E, and SWd is a switch. The cathode of d-c power source E2 is connected to the cathode of d-c power source E1 through protective resistor r, and the anode of d-c power source E2 is grounded while being connected to the anode of d-c power source E1 through switch SWd. The opposite electrode 31 is so connected as to have the same potential (ground) as that of the rotary magnetic mechanism 42 and the paper holding roll 43 in the developing part 40. In other words, the circuit of FIG. 13 is characterized in that the potential of opposite electrode 31 is equal to the potential of developing part 40 and also that it is the ground potential.

By virtue of the above configuration, the reference potential of d-c power source E1 can be set to a bias −E in response to turn-on of switch SWd. Thus, the circuit of FIG. 13 performs positive and negative charging selectively by switching the reference potential of d-c power source E1, whereas the circuit of FIG. 3 executes positive and negative charging by switching the voltage applied to the opposite electrode 31.

Figure 14:
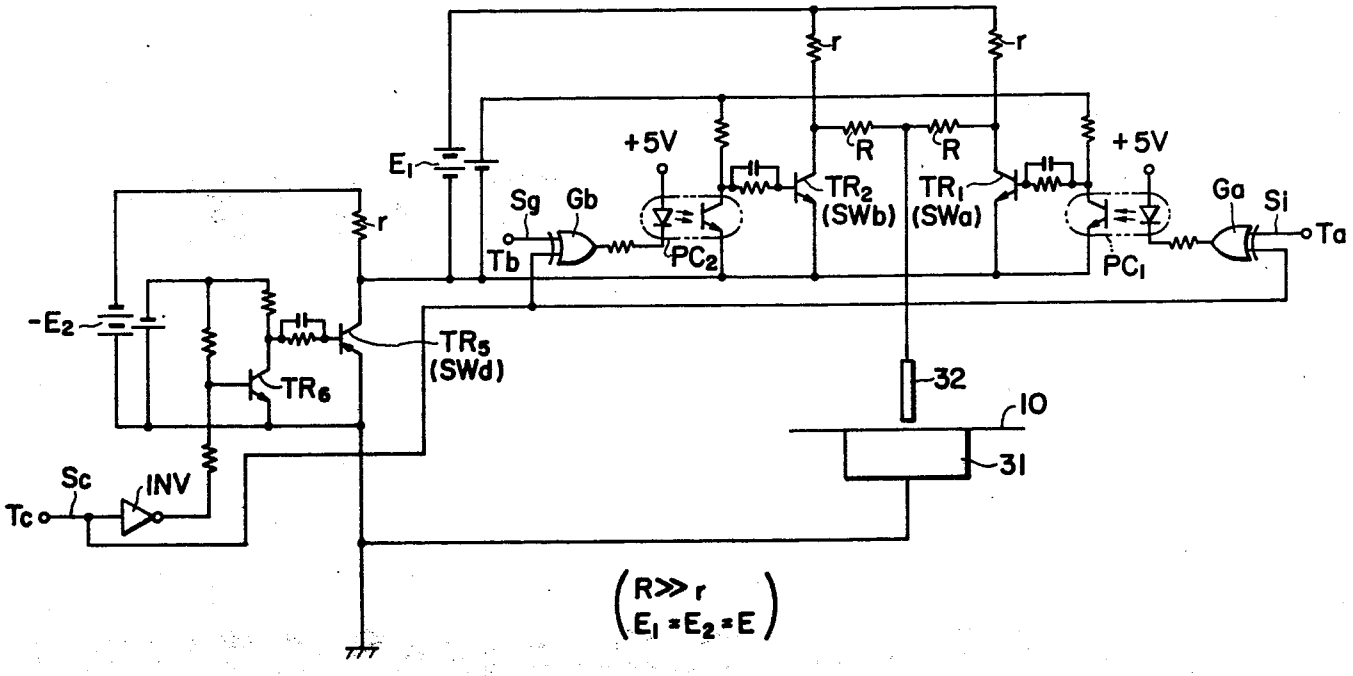
FIG. 14 is a detailed circuit diagram of the example of FIG. 13.

FIG. 14 is a detailed circuit diagram of the example shown in FIG. 13, wherein the component elements corresponding to those in FIG. 4 are labeled the same reference symbols. In FIG. 14: TR5 is a transistor serving as switch SWd; TR6 is a control transistor; and PC1 and PC2 are photo-couplers. The collector of transistor TR5 is connected to the cathode of d-c power source E1 and also to the cathode of d-c power source E2 through protective resistor r. The emitter of TR5 is grounded with the cathode of d-c power source E2 and the opposite electrode 31, and the base is connected to control transistor TR6 and also to input terminal Tc through inverter INV. The output terminal of exclusive OR gate Ga is connected to the base of transistor TR1 through photo-coupler PC1, and the output terminal of exclusive OR gate Gb is connected to the base of transistor TR2 through photo-coupler PC2. Therefore, transistors TR1 and TR2 for controlling the voltage applied to the opposite electrode 32 are electrically insulated, by means of photo-couplers PC1 and PC2, from exclusive OR gates Ga and Gb that control the action of these transistors. Thus, the reference potentials of switches SWa and SWb consisting of transistors TR1 and TR2 are freely settable without being limited by the reference potentials or output voltages of the exclusive OR gates Ga and Gb.

Figure 15:
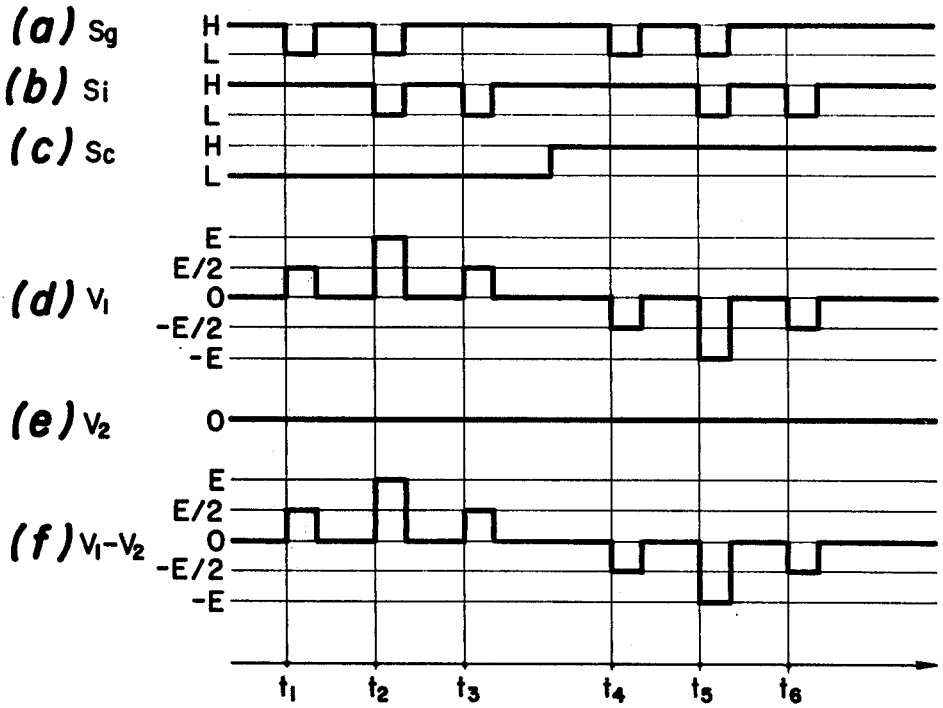
FIG. 15, including a-f, is a waveform chart plotted for explanation of the operation in FIG. 14.

FIG. 15 is a waveform chart plotted for explanation of the operation in FIG. 14, in which: (a) is the waveform of print control signal Sg applied to input terminal Tb; (b) is the waveform of print information signal Si applied to input terminal Ta; (c) is the waveform of color designation signal Sc applied to input terminal Tc; (d) is the waveform of voltage V1 applied to discharge electrode 32; (e) is the waveform of voltage V2 applied to opposite electrode 31; and (f) is the waveform of potential difference V1–V2 applied across print paper 10. At time t1 in FIG. 15, Sg and Sc are "L" while Si is "H" to cause turn-on of switch SWb and turn-off of switches SWa and SWb, so that the voltage applied to the discharge electrode 32 becomes E/2. Since the opposite electrode 31 is kept grounded, the potential difference applied across the print paper 10 is equal to the voltage applied to the discharge electrode 32, and consequently +E/2 is applied across the print paper 10. At time t2, all of Sg, Si and Sc are "L" to cause turn-off of switches SWa, SWb and SWd, so that the potential difference across the print paper 10 become +E to form a positive electrostatic latent image thereon. At time t3, Sg is "H" while Si and Sc are "L" to cause turn-on of switch SWa and turn-off of switches SWb and SWd, so that the potential difference across the print paper 10 becomes +E/2. At time t4, Sg is "L" while Si and Sc are "H" to cause turn-on of switches Swa and SWd and turn-off of switch SWb, so that the potential difference across the print paper 10 becomes −E/2. At time t5, Sg and Si are "L" while Sc is "H" to cause turn-on of all switches SWa, SWb and SWd, so that the potential difference across the print paper 10 becomes −E to form a negative electrostatic latent image thereon. Further at time t6, Sg and Sc are "H" while Si is "L" to cause turn-off of switch SWa and turn-on of switches Swb and SWd, so that the potential difference across the print paper 10 becomes −E/2.

Figure 16:
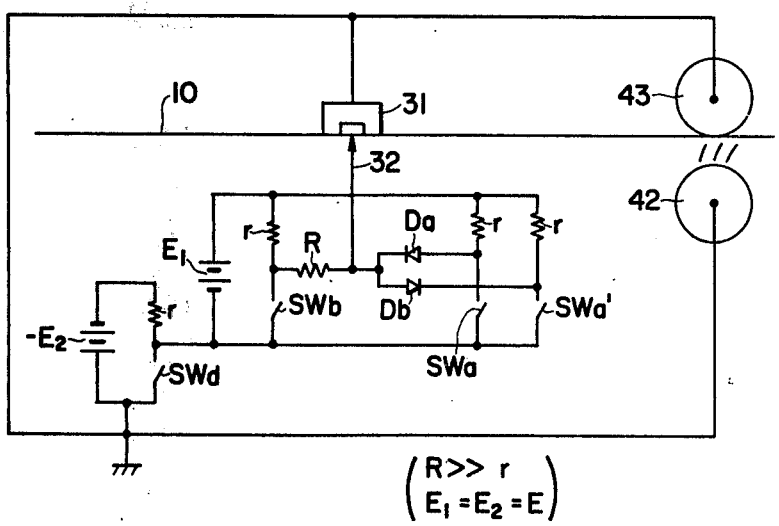
FIG. 16 is a schematic circuit diagram showing, with a developing part, another example of the charging part in FIG. 1.

According to the circuit of FIG. 13, as is apparent from the above, it is possible to obtain positive and negative electrostatic latent images by controlling only the voltage applied to the discharge electrode 32 in the state where the opposite electrode 31 is kept grounded. And due to the fact that the potential of the opposite electrode 31 is equal to the potential of the developing part 40 and also that it is the ground potential, such developing bias voltage as generated in the circuit of FIG. 3 never occurs in the space of the developing part 40, thereby ensuring high quality in the electrostatic printing. Moreover, if a plurality of paper holding rolls similar to the aforementioned roll 43 are installed in the vicinity of the opposite electrode 31 and are grounded, the potential on the base 11 of print paper 10 is rendered closer to the ground potential and free from the influence of variations occurring in the charge voltage, hence attaining stabler printing action. Occurrence of greasing in the circuit of FIG. 3 exits also in the circuit of FIG. 8. With respect to the latter circuit, the effect achieved in FIG. 13 is obtainable by the circuit shown in FIG. 16.

Figure 17:
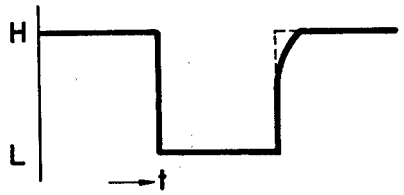
FIG. 17 represents exemplary switching characteristics of a transistor employed as a switch in the present invention.

When selectively driving the matrix of multiple cat-whiskers through switches consisting of transistors as in the foregoing exemplary circuits, undesired electrostatic latent images termed ghost may result from the switching characteristics of the transistors and deteriorate the printing quality. FIG. 17 represents exemplary switching characteristics of an n-p-n transistor employed as a switch in the present invention. In this diagram where the initial state is shown as "H" and the set state as "L", the time required for the trailing edge of output to restore "H" from "L" is longer than the time required for the leading edge to change from "H" to "L". Therefore, in the use of a switch having such characteristics, the leading edge of output signal (row drive signal) of a row drive circuit SWa overlaps the trailing edge of output signal (column drive signal) of a column drive circuit SWb, or the leading edge of column drive signal overlaps the trailing edge of row drive signal to generate an unrequired pulse.

Figure 18:
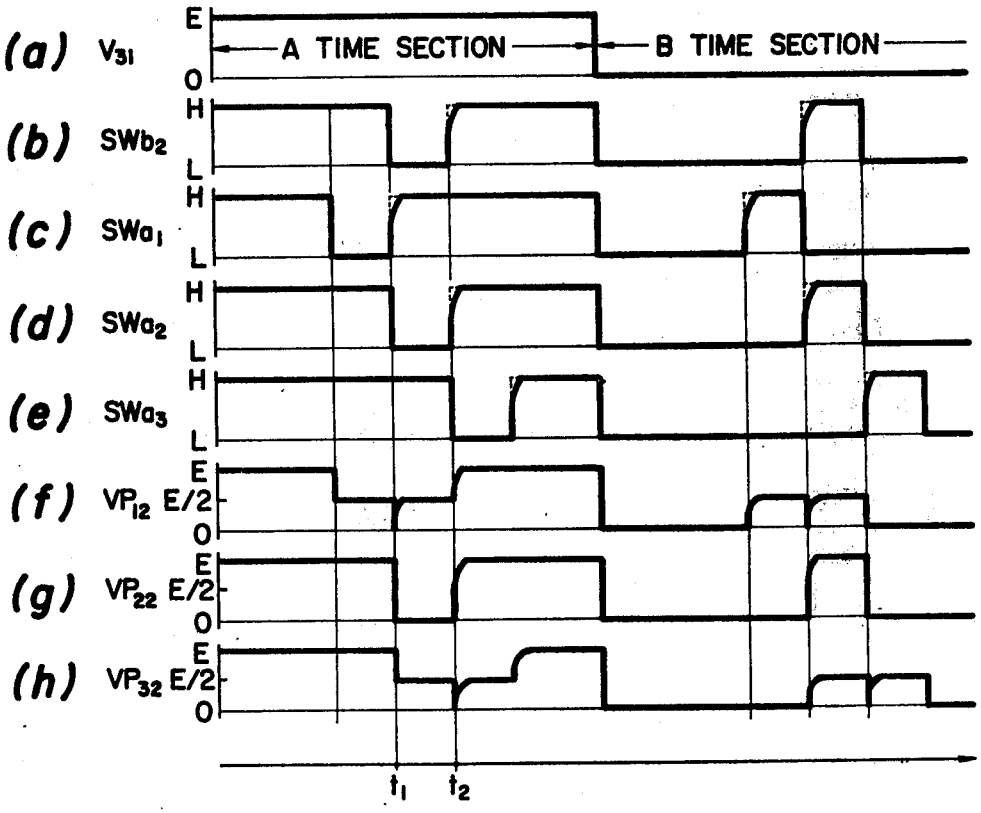
FIG. 18, including a-h, is a waveform chart plotted for explanation of the operation in FIG. 6 with regard to its switching characteristics.

FIG. 18 is a waveform chart plotted for explanation of this phenomenon occurring in the case of selectively driving the cat-whisker P22 in the circuit of FIG. 6, in which: (a) is the waveform of voltage V31 applied to opposite electrode 31; (b) is the waveform of output of switch SWb2; (c) through (e) are the waveforms of outputs of switches SWa1–Swa3; and (f) through (h) are the waveforms of voltages VP12, VP22 and VP32 applied to cat-whiskers P12, P22 and P32 respectively. In this chart, A-time section represents a period in which the trailing-edge time is longer than the leading-edge time with respect to the output waveform of each switch, and B-time section represents a period in which the leading-edge time is longer than the trailing-edge time. When switches SWa2 and SWb2 are actuated simultaneously at time t1 in FIG. 18, the voltage applied to cat-whisker P22 is changed to zero, and simultaneously the voltage applied to cat-whisker P12 is also changed to zero by the trailing edge of output signal of switch SWa1. And furthermore at time t2, the voltage applied to cat-whisker P32 is also changed to zero by the trailing edge of output signal of switch SWb2. Consequently, in addition to the latent image obtained by the selected cat-whisker P22, undesired images termed ghost are formed by cat-whiskers P12 and P32 as well. In B-time section, however, no ghost is formed at all. As is evident from FIG. 18, generation of ghost can be prevented by limiting the leading edge of output signal of each switch for a fixed time.

Figure 19:
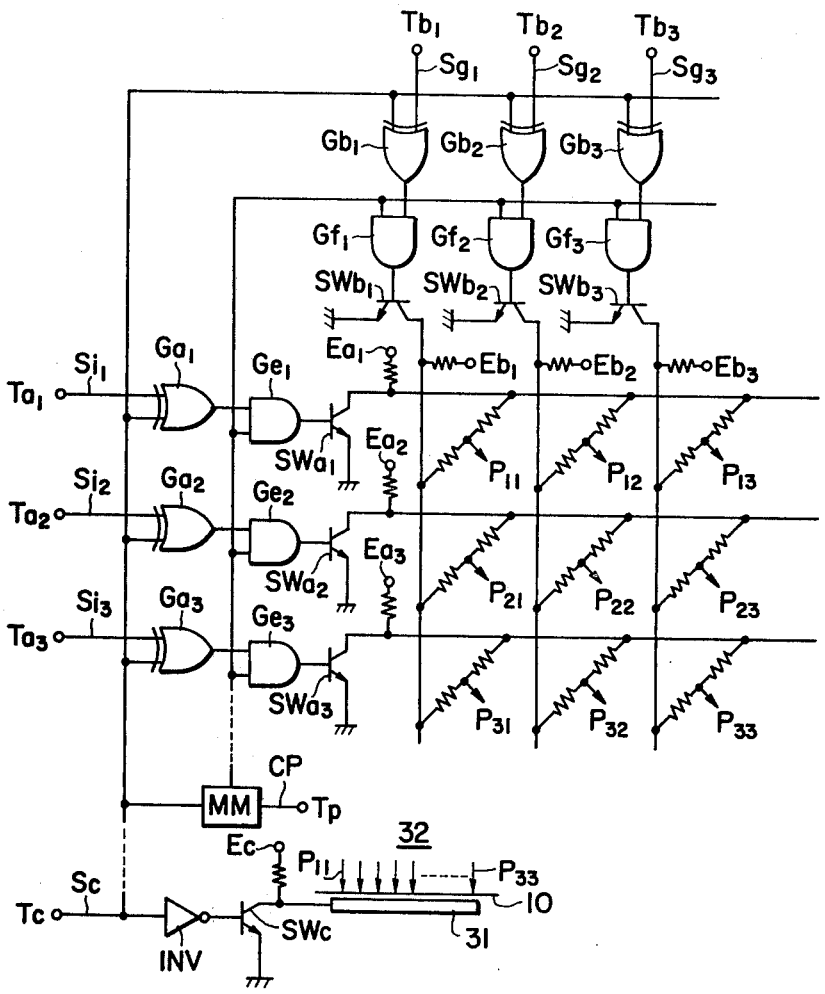
FIG. 19 is a circuit diagram showing another example of the charging part in FIG. 1.
Figure 20:
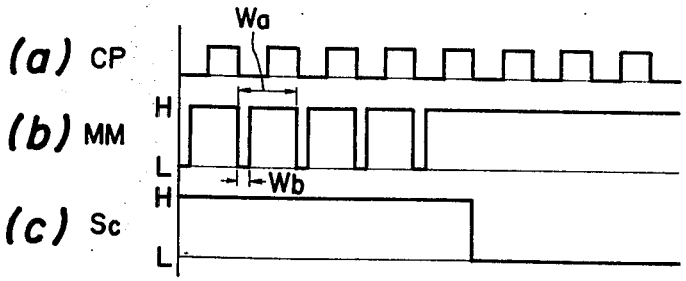
FIG. 20, including a-c, is a waveform chart plotted for explanation of the operation in FIG. 19.

FIG. 19 is a circuit diagram of an example adapted for prevention of such ghost, wherein the component elements corresponding to those in FIG. 6 are labeled the same reference symbols. In FIG. 19: MM is a monostable multivibrator; Ge1–Ge3 and Gf1–Gf3 are AND gates; and Tp is an input terminal for clock pulse CP. The output terminal of monostable multivibrator MM is connected to one input terminal of each of AND gates Ge and Gf, while the output terminals of switches SWa and SWb are connected to the other input terminals of Ge and Gf related thereto respectively. And both clock pulses CP and color designation signal Sc are fed to the monostable multivibrator MM. FIG. 20 is a waveform chart plotted for explaining the operation of monostable multivibrator MM, in which: (a) is the waveform of clock pulses CP; (b) is the waveform of the output of monostable multivibrator MM; and (c) is the waveform of color designation signal Sc. As will be understood clearly from this chart, the monostable multivibrator MM generates, when the color designation signal Sc is at its "H" level, a pulse signal which has a period Wa and limits the leading edge of each clock pulse CP for a time Wb. Switches SWa1–SWa3 and SWb1–SWb3 are so connected as to be controlled by the output signal of the monostable multivibrator MM. Therefore, when the color designation signal Sc is at its "H" level, the voltage obtained from each of the switches SWa1–SWa3 and SWb1–SWb3 is such that the leading edge is limited for the time Wb. Accordingly, by setting the time Wb to a proper value, it becomes possible to prevent overlap of the leading or trailing edges of the output voltages of one switch group SWa1–SWa3 and the trailing or leading edges of the output voltages of the other switch group SWb1–SWb3, hence ensuring high-quality electrostatic printing without any ghost.

Figure 21:
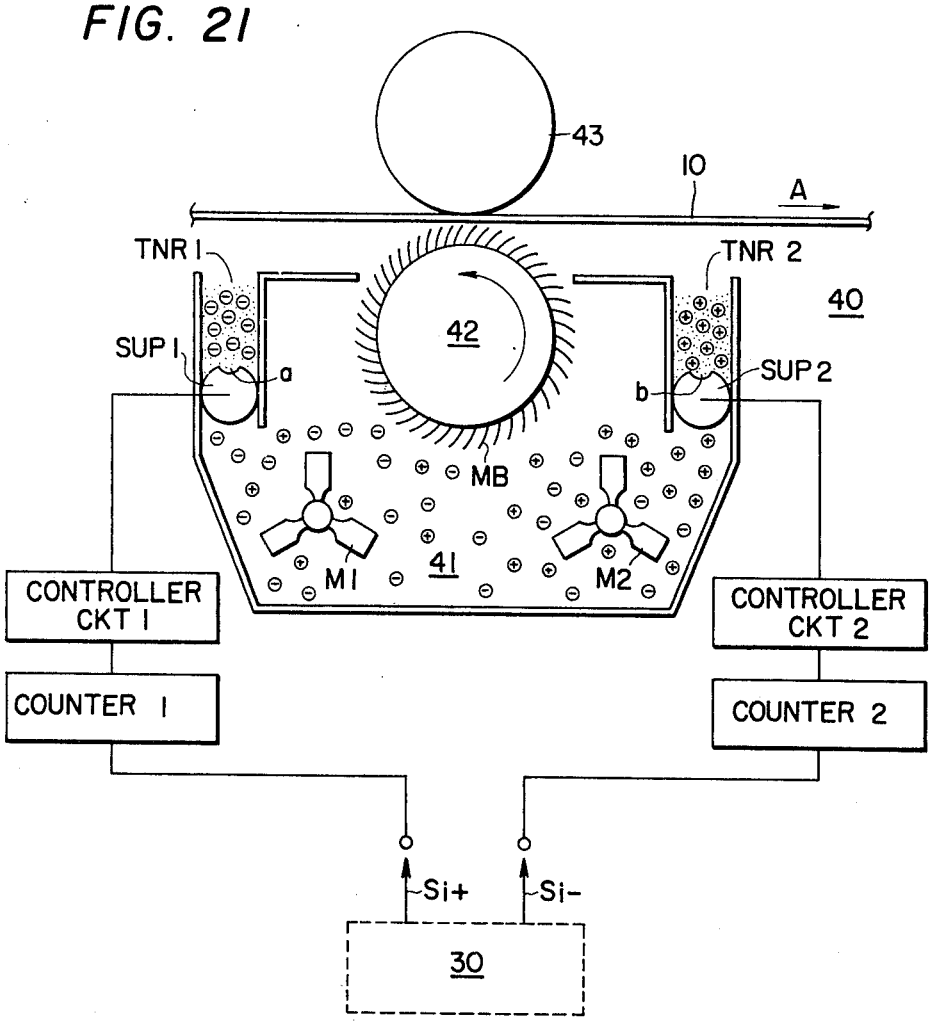
FIG. 21 illustrates the structure of a principal portion in an example of the developing part in FIG. 1.

FIG. 21 illustrates the structure of a principal portion in an example of the developing part 40 shown in FIG. 1, wherein the component elements corresponding to those in FIG. 1 are labeled the same reference symbols. In FIG. 21: TNR1 is a first toner charged in negative polarity; TNR2 is a second toner charged in positive polarity; SUP1 is a mechanism for supplying a fixed amount of the first toner TNR1; SUP2 is a mechanism for supplying a fixed amount of the second toner TNR2; M1 and M2 are mixers for mixing the two toners with a carrier (not shown); MB is a magnetic brush composed of a developer 41 on the outer surface of a rotary magnetic mechanism 42; CTR1 and CTR2 are counters; CNL1 and CNL2 are controllers for controlling the action of supply mechanisms SUP1 and SUP2; and Si+ and Si− are print information signals for forming positive and negative electrostatic latent images respectively.

The operation of the above structure is performed in the following manner. In the charging part 30, a positive electrostatic latent image is formed in response to one print signal Si+, whereas a negative electrostatic latent image is formed in response to the other print information signal Si−. The print information signals Si+ and Si− are counted by counters CTR1 and CTR2 individually, so that the numbers of the positive and negative latent images formed on the print paper 10 are countable respectively. The output signal of counter CTR1 is fed to controller CNL1, while the output signal of counter CTR2 is fed to controller CNL2. The controller CNL1 controls the action of supply mechanism SUP1 in response to the output value of counter CTR1 so as to control the supply amount of toner TNR1, while the controller CNL2 controls the action of supply mechanism SUP2 in response to the output value of counter CTR2 so as to control the supply amount of toner TNR2. The controllers CNL1 and CNL2 drive the supply mechanisms SUP1 and SUP2 in such a mode as to cause one rotation whenever the respective outputs of counters CTR1 and CTR2 reach a fixed value, thereby supplying a fixed amount of toners TNR1 and TNR2 by notches a and b formed on the outer surfaces of supply mechanisms SUP1 and SUP2. Therefore, the new toners TNR1 and TNR2 supplied to the developing part 40 are equal in quantity to those consumed in accordance with the numbers of positive and negative latent images formed in the charging part 30, and thus the amount of the toners in the developer 41 is always maintained at the optimal value. Since the developer 41 containing toners TNR1 and TNR2 is mixed continuously by means of mixers M1 and M2, it is kept uniform to produce visible images of a fixed density on the print paper 10. The conductivity of magnetic brush MB can be enhanced by increasing the conductivity of the carrier which is composed normally of iron powder and is mixed into the developer 41. This enables the rotary magnetic mechanism 42 to function as a developing electrode to attain improvement in the developing characteristics. Furthermore, it is effective in simplifying the structure of the developing part, which is thereby allowed to be fixed at the ground potential.

Figure 22:
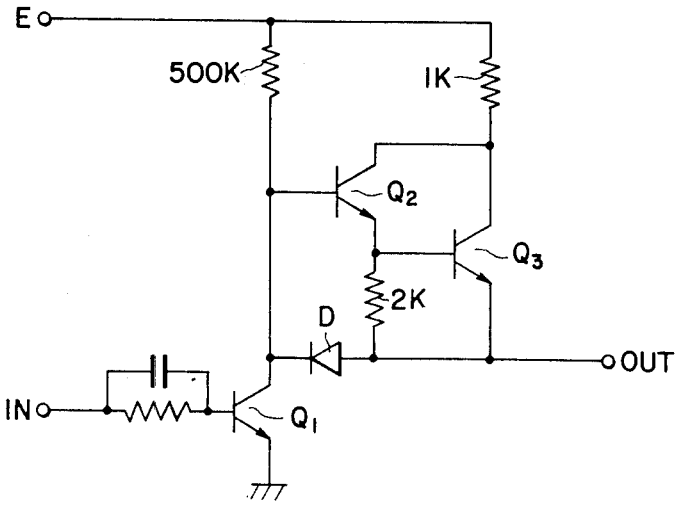
FIG. 22 is a circuit diagram showing an example of the switch employed in the invention.

FIG. 22 shows an exemplary circuit usable as a switch SWa, SWa', SWb, SWc or SWd in the present invention, in which three transistors Q1–Q3 constitute a totem-pole output type switch. In this circuit, power loss is extremely small since the transistors Q1–Q3 are turned on or off always complementarily, and its output impedance is low to offer a high efficiency.

As described hereinabove, the two-color electrostatic printing apparatus accomplished by the present invention has a relatively simple structure and is still capable of performing clear two-color printing. Accordingly, it is adapted for use in line printer, recorder, facsimile, plotter and so forth.

What we claim is:

1. A two-color electrostatic printing apparatus comprising a charging part with a discharge electrode and an opposite electrode on opposite sides of a moving dielectric for applying positive and negative electrostatic latent images having opposite electric polarities, and a developing part for applying first and second toners having opposite electric polarities to respective ones of said positive and negative electrostatic latent images, wherein said charging part of said printing apparatus comprises a discharge electrode including electrode pins arrayed in a row in the direction orthogonal with the movement of said dielectric, and electric circuit means responsive to at least one signal for selectively actuating said electrode pins according to predetermined positive and negative electrostatic image patterns and responsive to a color designation signal for sequentially inverting the polarity of voltage differences between said discharge electrode and said opposite electrode to provide latent image patterns in rows of alternating polarities.

2. The two-color electrostatic printing apparatus as defined in claim 1, wherein said discharge electrode includes multiple electrode pins arrayed to shape a matrix, the electrode pins being driven selectively by a first drive circuit group controlled through a color designation signal and a print information signal, and by a second drive circuit group controlled through the color designation signal and a print control signal; first drive lines belonging to the first drive circuit group being connected respectively to second drive lines belonging to the second drive circuit group through voltage-dividing resistance circuits and the electrode pins being connected to the midpoints of respective voltage-dividing resistance circuits individually, the electrode pins and the voltage-dividing resistance circuits being arranged on a single base plate.

3. The two-color electrostatic printing apparatus as defined in claim 1 wherein said discharge electrode includes multiple electrode pins arrayed to shape a matrix, the electrode pins being driven selectively by first and third drive circuit groups controlled through the color designation signal and a print information signal, and by a second drive circuit group controlled through the color designation signal and a print control signal; first drive lines belonging to the first drive circuit group being connected respectively to second drive lines belonging to the second drive circuit group through series circuits each including a resistor and a first diode, while drive lines belonging to the third drive circuit group are connected respectively to said second drive lines through series circuits each consisting of said resistor and a second diode connected in the direction opposite in polarity to said first diode; each of the electrode pins being connected to the midpoint of the resistor and the first and second diodes of the related series circuits, the electrode pins and voltage dividing circuits being arranged on a single base plate.

4. A two-color electrostatic printing apparatus having:

print paper of a low-resistance base and a dielectric layer formed on the surface thereof; a paper feed mechanism for driving the print paper; a charging part comprising a discharge electrode and an opposite electrode which are disposed on opposite sides of the print paper and to which predetermined voltages are applied via drive circuits controlled by a color designation signal, a print information signal and a print control signal, wherein positive and negative electrostatic latent images corresponding to the polarities of the potential difference between said electrodes are formed selectively on the print paper when the potential difference reaches a value sufficient to form the image; a developing part comprising a developer which is a mixture of a carrier and first and second toners charged in different polarities and presenting different colors, and a rotary magnetic mechanism for producing a magnetic brush by magnetically attracting the developer, said magnetic brush being brought into contact with the print paper to render the positive and negative electrostatic latent images visible in two respective colors simultaneously; and a fixing part comprising a heating means disposed opposite to the print paper and serving to fuse the toners on the print paper, wherein said charging part comprises a discharge electrode including electrode pins arrayed in a row in the direction orthogonal with the paper feed direction and the positive and negative electrostatic latent images are formed by inverting the polarity of voltages applied between the discharge electrode and the opposite electrode;

said print paper is driven at a predetermined speed relative to inversion of the polarity of the color designation signal such that the positive and negative electrostatic latent images are formed in alternating rows; and the positive and negative electrostatic latent images formed in the charging part are counted, and the amounts of the first and second toners to be supplied are controlled individually in accordance with the counts thus obtained to maintain the toners in the developer at a fixed density.

5. The two-color electrostatic printing apparatus as defined in claim 4 wherein said discharge electrode includes multiple electrode pins arrayed to shape a matrix, the electrode pins being driven selectively by a first drive circuit group controlled through the color designation signal and the print information signal, and by a second drive circuit group controlled through the color designation signal and the print control signal; first drive lines belonging to the first drive circuit group being connected respectively to second drive lines belonging to the second drive circuit group through voltage-dividing resistance circuits and the electrode pins being connected to the midpoints of respective voltage-dividing resistance circuits individually, the electrode pins and the voltage-dividing resistance circuits being arranged on a single base plate.

6. The two-color electrostatic printing apparatus as defined in claim 5 wherein said discharge electrode and said opposite electrode are both driven by a single power source.

7. The two-color electrostatic printing apparatus as defined in claim 5 wherein said opposite electrode and said developing part are always kept grounded so that the reference potential of each drive circuit group for driving the discharge electrode is varied according to inversion of the polarity of the color designation signal.

8. The two-color electrostatic printing apparatus as defined in claim 5 wherein the leading edge of each output signal of the drive circuit groups is delayed for a predetermined time so as to prevent overlap of the leading or trailing edge of one output signal and the trailing or leading edge of the other output signal.

9. The two-color electrostatic printing apparatus as defined in claim 5 comprising a detecting circuit for detecting the print information signal applied to the first drive circuit group; and a control circuit for controlling the print control signal to be sent to the second drive circuit group according to the print information signal detected by said detecting circuit.

10. The two-color electrostatic printing apparatus as defined in claim 4 wherein said discharge electrode includes multiple electrode pins arrayed to shape a matrix and driven selectively by first and third drive circuit groups controlled through the color designation signal and the print information signal, and by a second drive circuit group controlled through the color designation signal and the print control signal; first drive lines belonging to the first drive circuit group being connected respectively to second drive lines belonging to the second drive circuit group through series circuits each including a resistor and a first diode, while third drive lines belonging to the third drive circuit group are connected respectively to said second drive lines through series circuits each consisting of said resistor and a second diode connected in the direction opposite in polarity to said first diode; each of the electrode pins being connected to the midpoint of the resistor and the first and second diodes of the related series circuits; the electrode pins and voltage dividing circuits being arranged on a single base plate.

11. The two-color electrostatic printing apparatus as defined in claim 10 wherein said discharge electrode and said opposite electrode are both driven by a single power source.

12. The two-color electrostatic printing apparatus as defined in claim 10 wherein said opposite electrode and said developing part are always kept grounded so that the reference potential of each drive circuit group for driving the discharge electrode is varied according to inversion of the polarity of the color designation signal.

13. The two-color electrostatic printing apparatus as defined in claim 10 wherein the leading edge of each output signal of the drive circuit groups is delayed for a predetermined time so as to prevent overlap of the leading or trailing edge of one output signal and the trailing or leading edge of the other output signal.

14. The two-color electrostatic printing apparatus as defined in claim 10 comprising a detecting circuit for detecting the print information signal applied to the first and third drive circuit groups; and a control circuit for controlling the print control signal to be sent to the second drive circuit group according to the print information signal detected by said detecting circuit.

* * * * *